US006079564A

United States Patent [19]

DeNola

[11] Patent Number: 6,079,564

[45] Date of Patent: Jun. 27, 2000

[54] CORRUGATED CUSHIONED INSERTS

[76] Inventor: Robert C. DeNola, c/o Dymax Packaging Corporation, San Jose, Calif. 95131

[21] Appl. No.: 09/285,130

[22] Filed: Apr. 2, 1999

Related U.S. Application Data

[60] Provisional application No. 60/080,442, Apr. 2, 1998.

[51] Int. Cl.[7] ..... B65D 81/07

[52] U.S. Cl. ..... 206/723; 206/583

[58] Field of Search ..... 206/521, 583, 206/591, 594, 701, 722, 723

[56] References Cited

U.S. PATENT DOCUMENTS

| | | | |
|---|---|---|---|
| 2,755,982 | 7/1956 | Vander Lugt, Jr. | 206/521 |
| 2,828,902 | 4/1958 | Ringler | 206/521 |
| 2,970,739 | 2/1961 | Levkoff | 229/161 |
| 3,079,061 | 2/1963 | Wojcik | 206/521 |
| 3,220,632 | 11/1965 | Persson | 206/583 |
| 3,572,574 | 3/1971 | Mears | 206/521 |
| 3,692,264 | 9/1972 | Burkhard et al. | 248/621 |
| 3,720,366 | 3/1973 | Martin | 206/521 |
| 4,606,460 | 8/1986 | Luray | 206/583 |
| 4,759,446 | 7/1988 | Dobashi et al. | 206/521 |
| 5,259,507 | 11/1993 | Smith | 206/583 |
| 5,287,968 | 2/1994 | Ridgeway | 206/583 |
| 5,676,245 | 10/1997 | Jones | 206/583 |
| 5,836,450 | 11/1998 | Gonzales | 206/521 |
| 5,894,932 | 4/1999 | Harding et al. | 206/583 |

*Primary Examiner*—Jim Foster

*Attorney, Agent, or Firm*—Thompson Hine & Flory LLP

[57] ABSTRACT

The present invention provides an apparatus for packaging electrical components such as circuit boards, lap top computer, etc., within a carton, and, more particularly, to an insert for packaging electrical components within a carton being pivotable about a pair of hinge lines to absorb outside forces.

6 Claims, 8 Drawing Sheets

CORRUGATED CUSHIONED INSERTS

CROSS REFERENCE TO RELATED APPLICATIONS

This application claims priority to U.S. provisional application Ser. No. 60/080,442, filed Apr. 2, 1998.

FIELD OF THE INVENTION

The invention relates to an apparatus for packaging electrical components such as circuit boards, lap top computers, etc., within a carton, and, more particularly, to an insert for packaging electrical components within a carton being pivotable about a pair of hinge lines to absorb outside forces.

BACKGROUND

It is often desired to ship fragile electronic devices, such as computer chassis, network hubs, and disk drives in a manner which ensures that the components are adequately protected from external loads and forces that may be imparted during shipping. It is further desired to ship the electronic devices in a package that is constructed completely of paper due to its relatively low manufacturing costs and lightweight qualities. However, most existing paper packaging systems fail to adequately protect their enclosed electronic components.

The prior art has attempted to address this problem by utilizing packages in which the electronic item is encased in collapsible cardboard. However, these packaging systems have shortcomings in that once they allow the component to move, the collapsible cushion becomes crushed and does not thereafter return to its original shape. Thus, the package loses its ability to protect its contents and subsequent or repeated forces or loads may damage the component.

Accordingly, there exists a need for a lightweight packaging system which is capable of flexing to absorb loads, yet can avoid crushing and return to its original shape to thereafter absorb subsequent loads or forces.

SUMMARY OF THE INVENTION

The present invention provides for a packaging system which is lightweight, helps to protect the packaged component, allows the system to flex when external forces are applied, and can return to its original shape to thereafter absorb subsequent forces. The present invention utilizes a pair of inserts which can be slid, as a sleeve, over the component to be packaged. The inserts are slid over each end of the component. In an alternate embodiment of the invention, the packaging system comprises a unitary packaging system to receive the item to be packaged. In the alternate embodiment, the component is slid into the packaging system which receives and protects the component.

Once assembled, the insert or inserts rest upon a pair of feet which serve to elevate or suspend the electronic component within the carton. The component is displaced from each of the walls and the top and bottom of the carton. Furthermore, the feet pivotally extend from a pair of hinge lines which allow the feet to pivot or flex when external forces are applied to the system. Once the external forces are removed, the feet reciprocatingly flex along the pivot lines to return to their original position. The present invention allows significant movement of the feet without destroying the intrinsic properties of the uncrushed corrugated board. This flexing ability serves to reduce the maximum forces which the electronic component receives during shipping.

In a preferred embodiment cushioned side panels are provided which serve to absorb forces applied to the side of the packaging carton. In this manner, the component is protected from loads on all sides. Furthermore, because the present invention may be fabricated completely of corrugated board, the packaging system of the present invention remains lightweight. Additionally, the means of manufacturing are quite common and simple, as the only steps required are diecut and straight-line glueing. The invention resides in an insert to be used in conjunction with another insert, a blank for forming a single insert to be used in conjunction with another insert, and a packaging assembly comprised of two inserts and a carton or regular slotted container.

DETAILED DESCRIPTION

Figure 1:
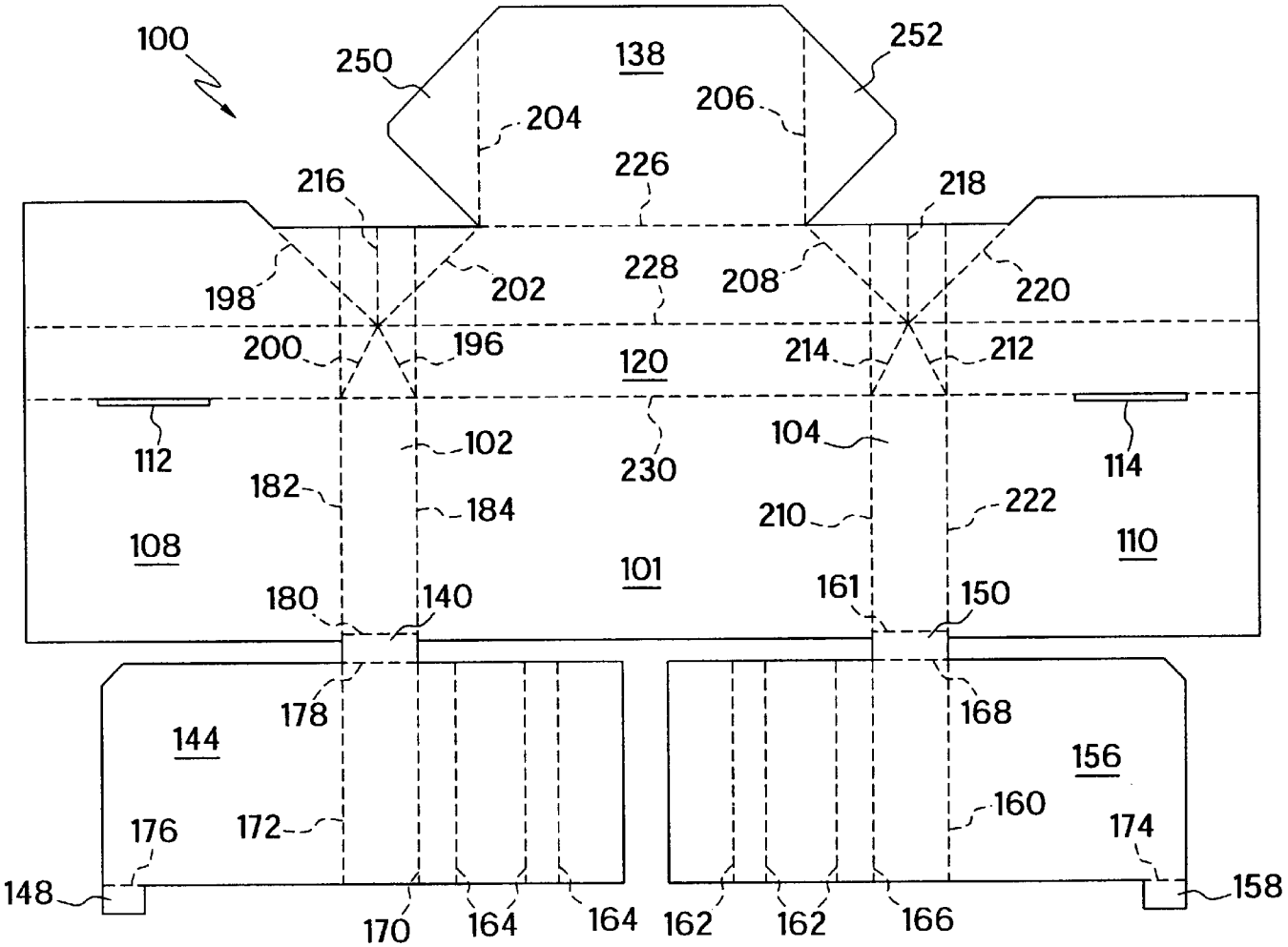
FIG. 1 is an overhead plan view of a single die-cut corrugated cushioned insert of the present invention prior to folding and glueing.
Figure 2:
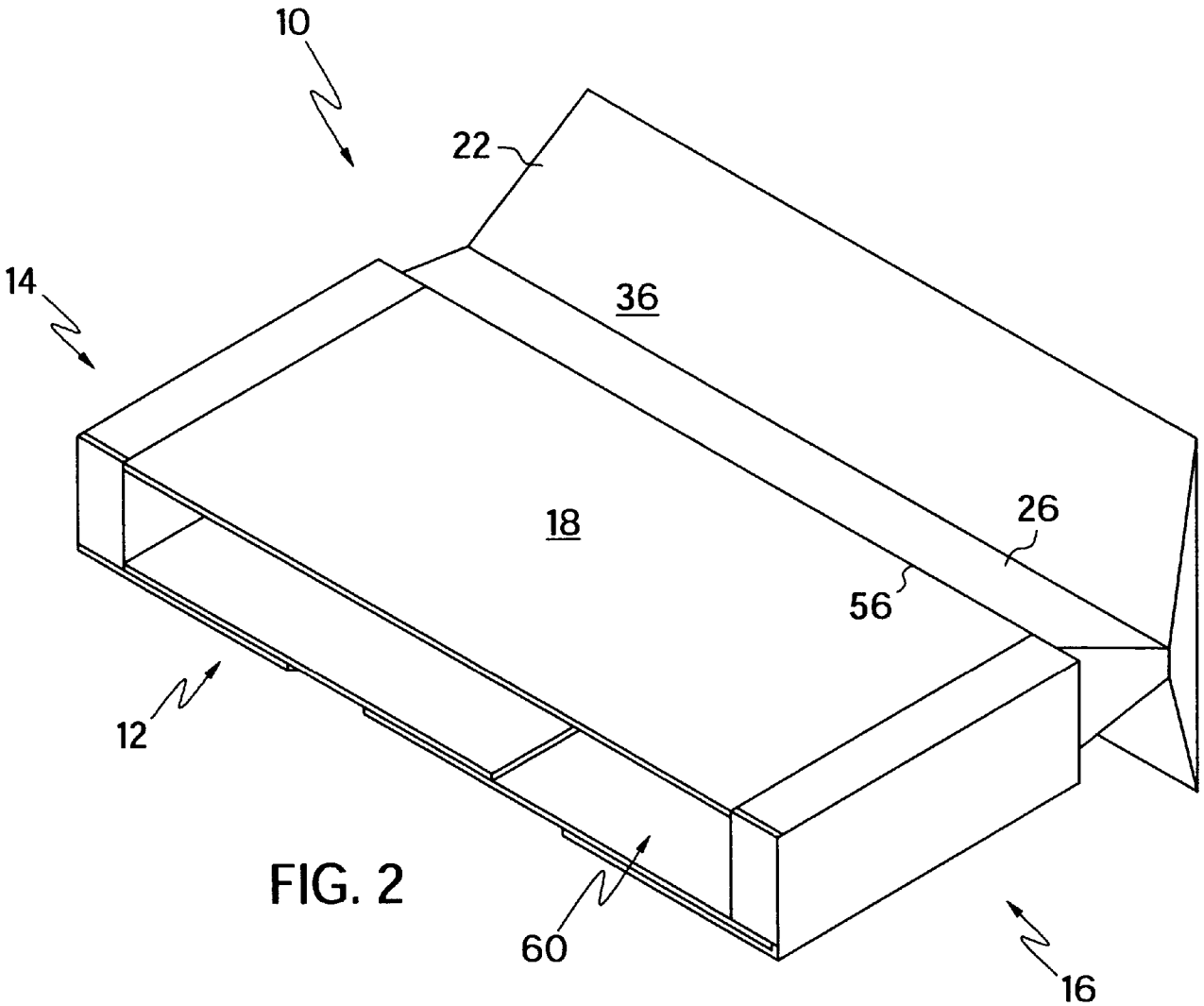
FIG. 2 is a top perspective view of a single folded and glued corrugated insert of FIG. 1.
Figure 3:
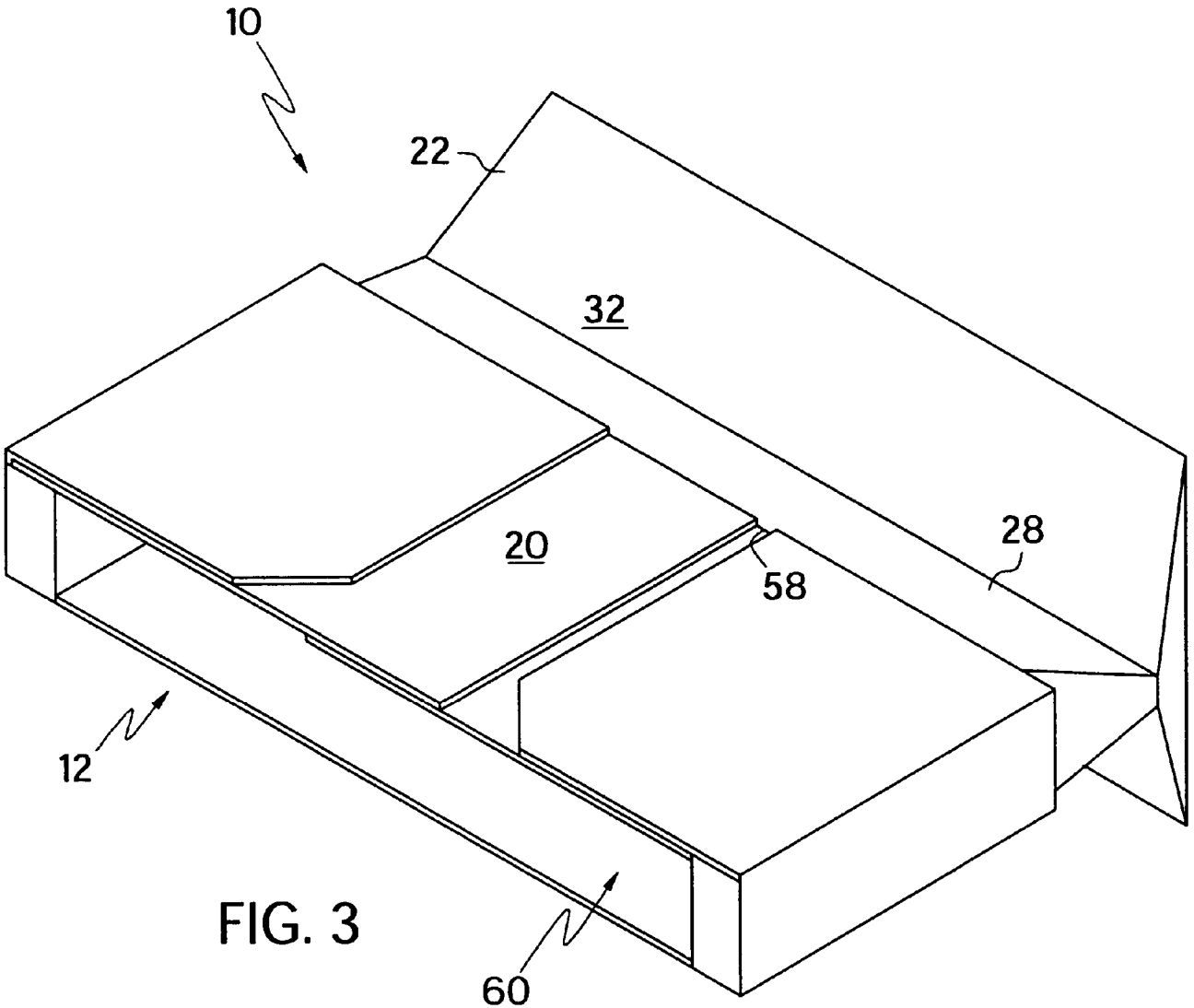
FIG. 3 is a bottom perspective view of a single folded and glued corrugated insert of FIG. 1.
Figure 4:
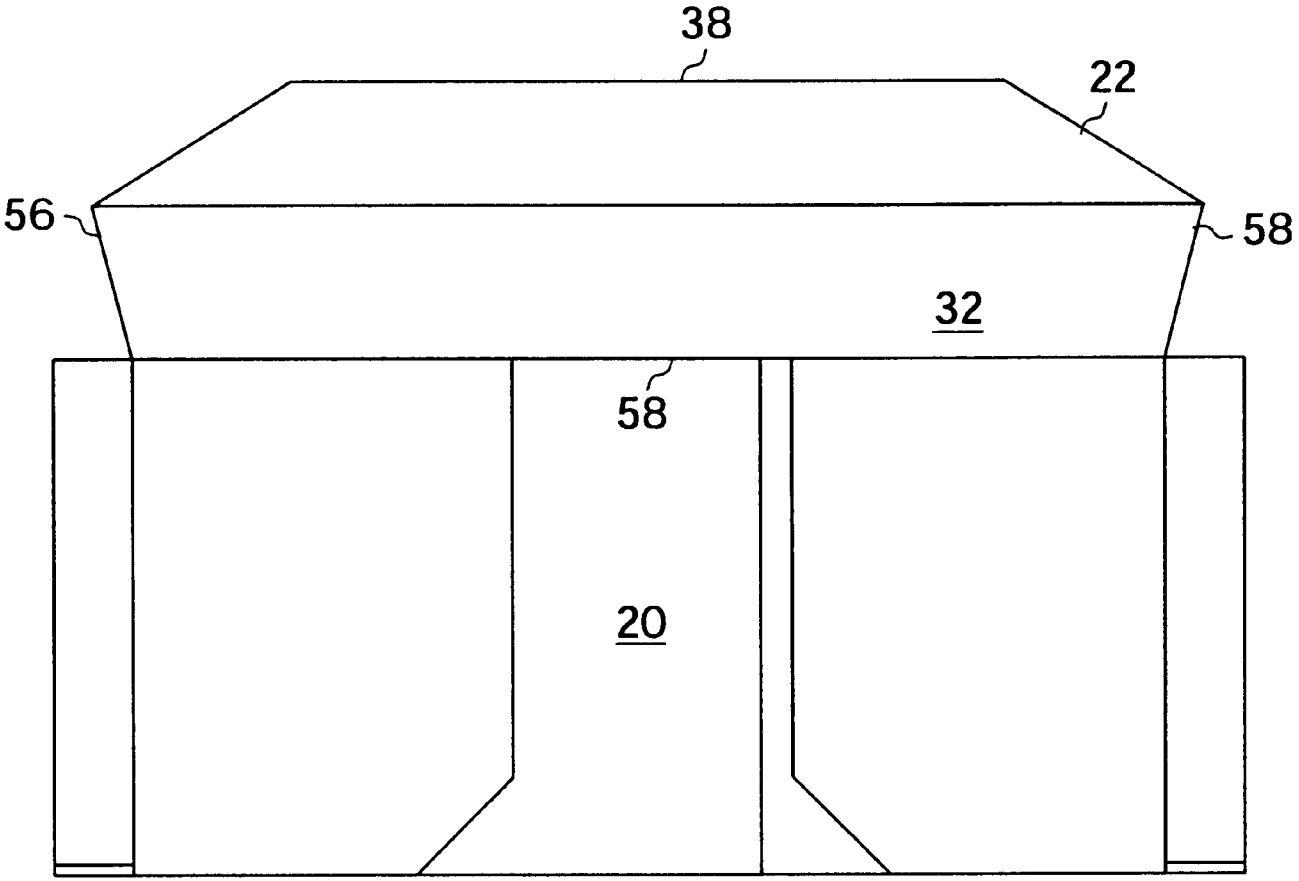
FIG. 4 is bottom plan view of a single folded and glued corrugated insert of FIG. 1.
Figure 5:
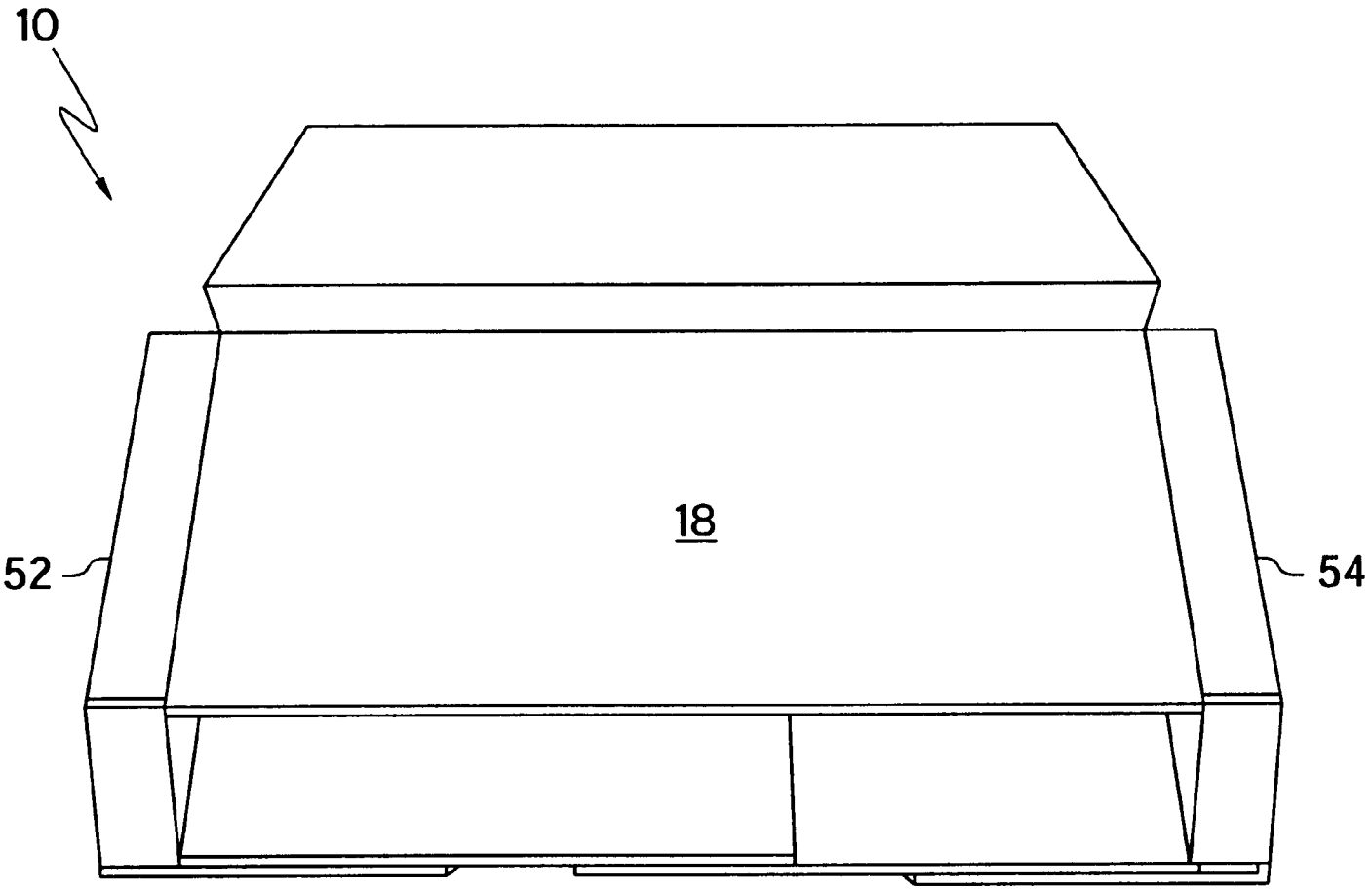
FIG. 5 is a side perspective view of the base and foot portions of the corrugated insert of FIG. 1.
Figure 6:
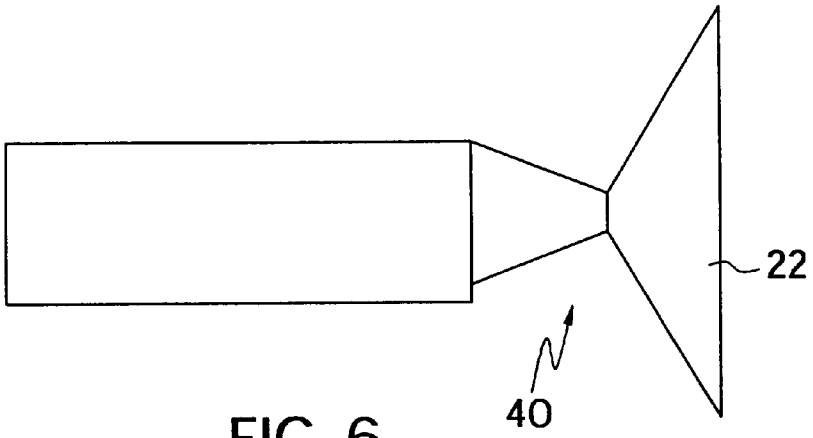
FIG. 6 is a side elevational view of the base and foot portions of the corrugated insert of FIG. 1.
Figure 7:
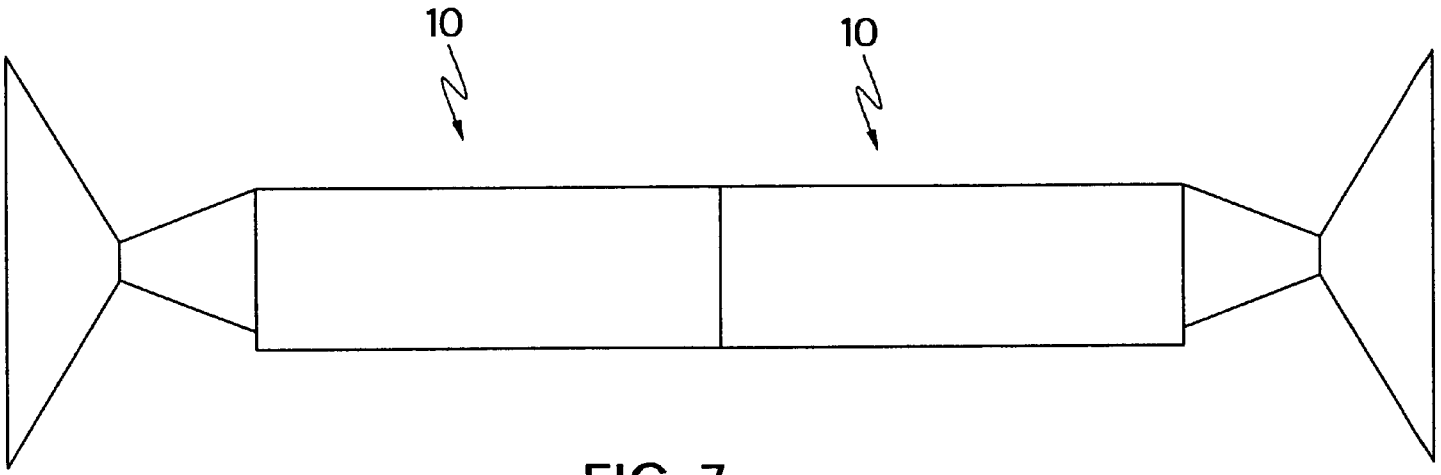
FIG. 7 is a side perspective view of two folded and glued corrugated cushioned inserts of the present invention ready to be inserted in a regular slotted container or carton for shipping.
Figure 8:
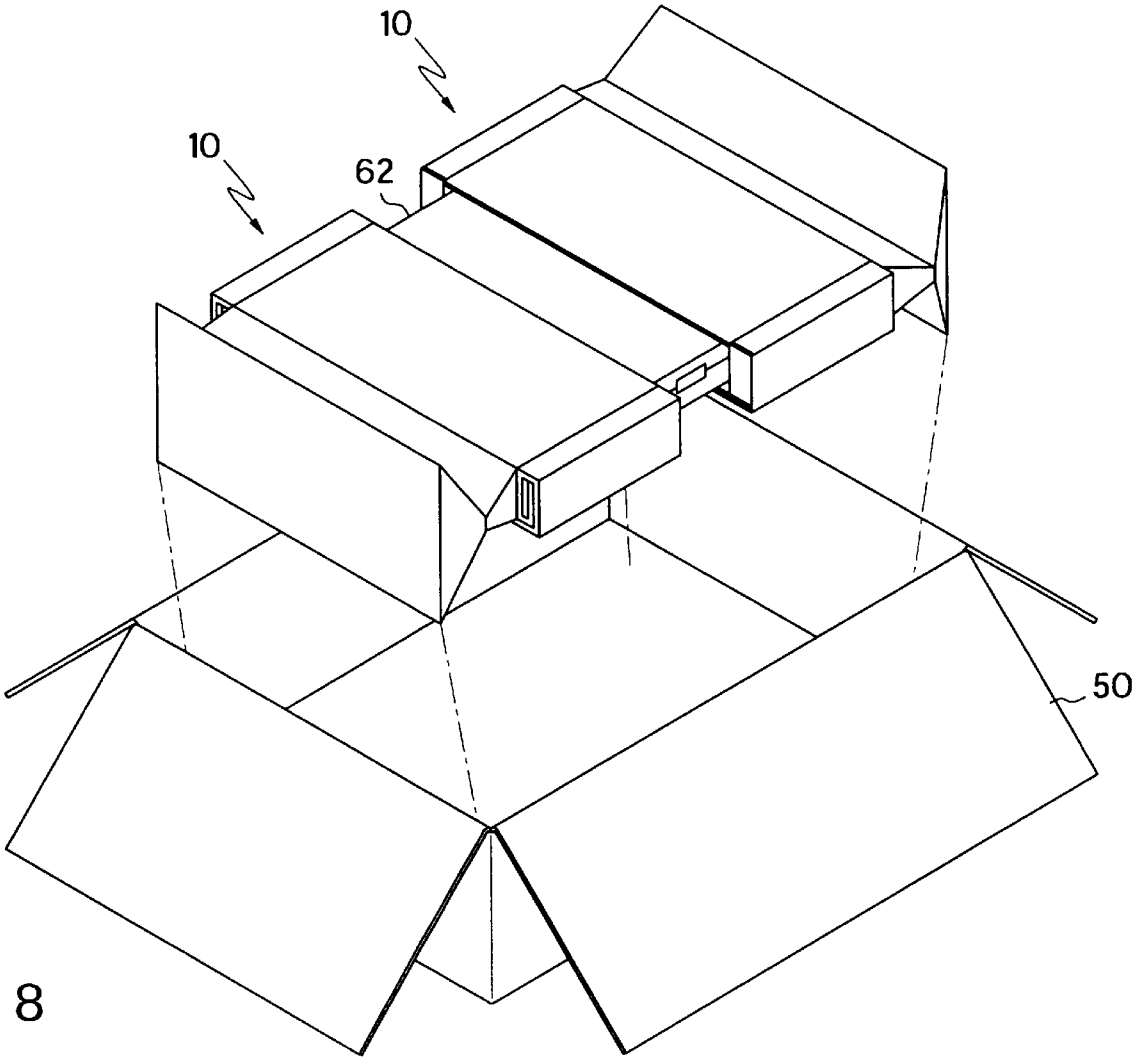
FIG. 8 is a side perspective view of the inserts of FIG. 7 during assembly with a regular slotted container or carton.
Figure 9:
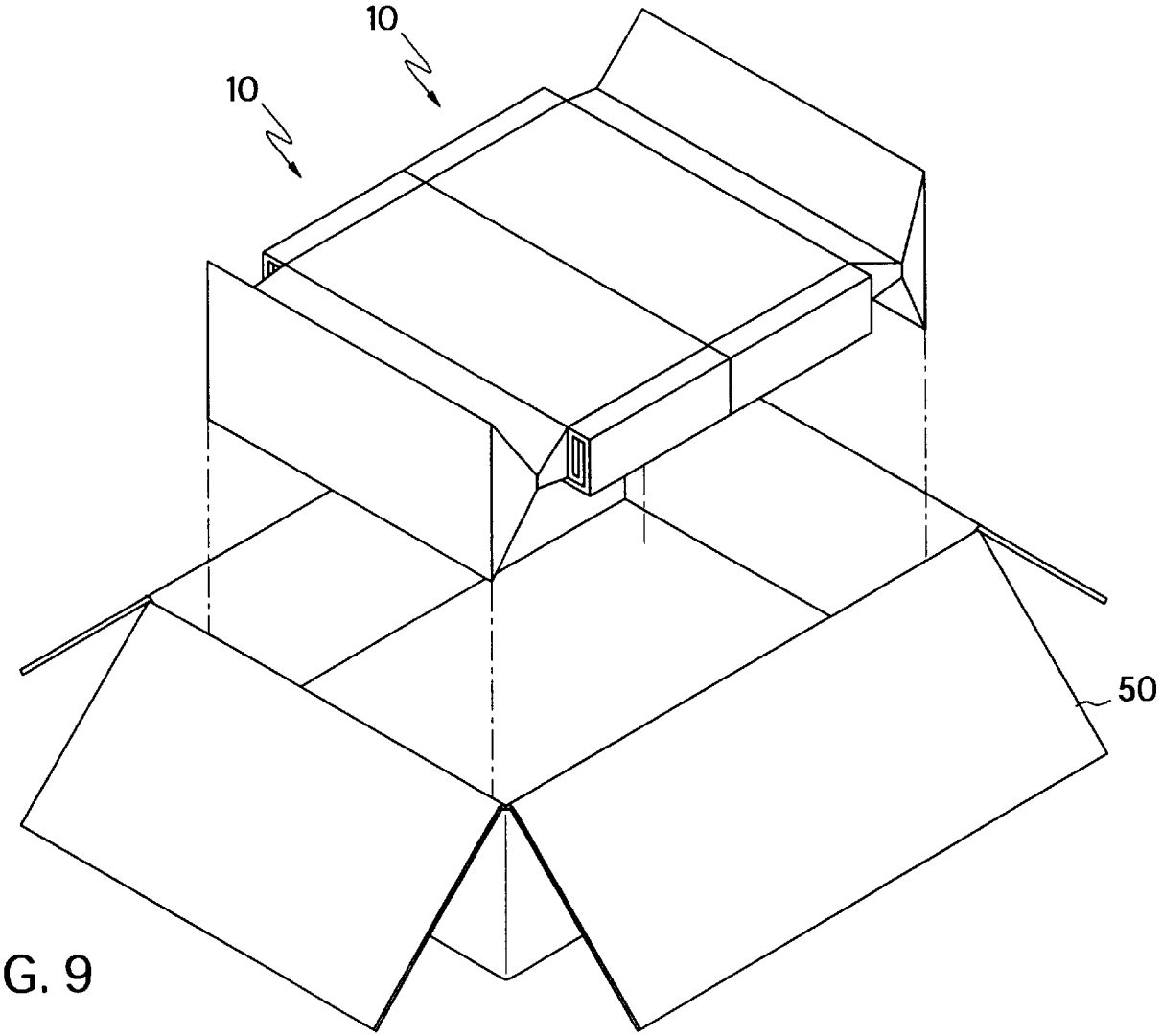
FIG. 9 is a picture of two corrugated inserts of the present invention seated in a regular slotted container or carton ready for shipping.

The applicant's invention provides for a pair of inserts, generally designated 10, to be used in conjunction with a regular slotted container 50 to package an electronic component 62 to be shipped. An insert of the present invention, generally designated 10, has a horizontally-oriented compartment 12 to receive the electronic component 62. The insert 10 has a pair of side panels 14, 16, a top panel 18, and a bottom panel 20. The insert 10 is to be used in conjunction with an identical insert and a regular slotted container or carton 50. Once the inserts are placed on either side of the electric component 62, the entire assembly is placed within a carton 50, which is then closed and ready to be shipped. The compartment 12 is generally rectangular in cross-section. The compartment 12 receives roughly one-half of the component 62 to be packaged. The outer perimeter of each compartment 12 defines a mouth 60 for receiving the electrical component 62.

The insert further comprises a foot 22 for contacting the carton bottom 24. The foot 22 extends downwardly below the compartment 12 and thereby suspends, or elevates, the compartment 12 and the component 62 above the carton bottom 24. The foot 22 is pivotable about a pair of hinge lines 26, 28. The hinge lines are opposed, parallel fold lines. The first hinge line 26 is located on the top panel 18 and the second hinge line 28 is located on the bottom panel 20. The first hinge line 26 is located at the intersection of the top inwardly inclined surface 30 and the top outwardly inclined surface 34. The second hinge line is located at the intersection of the bottom inwardly inclined surface 32 and the bottom outwardly inclined surface 36. The foot 22 is comprised of the top outwardly inclined surface 34, the bottom outwardly inclined surface 36, and the base 38. The foot is substantially triangular in cross-section. The base 38 of the present invention provides structural support to the foot.

Inclined surfaces 30, 32, 34, 36 and the hinge lines 26, 28 are formed by collapsing, or crimping, the compartment 12 inwardly. In this manner, the compartment 12 flares out slightly, shown as "flare outs" 40. The hinge lines, the inclined portions, and a pair of fold lines 56, 58 are also created as a result of the crimping of the compartment 12. The fold lines 56, 58 define the break between the top panel 18 and the top inwardly inclined surface 30, and between the bottom panel 20 and the bottom inwardly inclined surface 32. The fold lines 56, 58 are substantially parallel. Upper fold line 56 is located on the upper surface 18 and lower fold line 58 is located on the bottom panel 20.

The foot 22 is pivotable and flexible. Thus, when forces or loads are applied to the carton system, the foot 22 will flex or pivot and absorb a portion of the force. The cushioning function of the foot can be illustrated as follows. Generally speaking, the foot effectively compensates for lateral forces; that is, forces applied in a direction generally perpendicular to the plane of the base 38. When such lateral forces are applied, the foot acts in a spring-like manner, as it flexes in response to the force and tends to flatten. Once the force is removed, the foot expands and returns to its original position, and then is ready to absorb further loads.

The foot also effectively compensates for axial forces; that is, forces applied in a direction generally perpendicular to the upper panel 18 and the bottom panel 20. These forces may be applied to the system during a drop. When axial forces are applied, the foot rotates about the hinge lines 26, 28. In this manner, the foot will absorb a portion of the applied force thereby protecting the electrical component 62. After helping to absorb the force, the foot 22 will then rotate in the reverse direction, and return to its original position.

The flared ends of the compartment are folded inwardly, thereby creating triangular pockets 44. The base 38 has triangular tabs 46, 48 at opposed ends of the base. The triangular pockets 44 are shaped to receive the triangular tabs 46, 48. In this manner, the base 38 may be retained by the triangular pockets 44 in a substantially vertical orientation. While the present invention is herein described as essentially horizontally oriented with a vertically oriented base 38, those skilled in the art will appreciate that the present invention may be utilized in a variety of orientations, including an orientation wherein the compartment 12 is substantially vertically oriented and the base 38 is substantially horizontally oriented. It is to be understood that the use of the terms horizontal and vertical used herein are merely intended as illustrative aids.

A pair of side elements 52, 54 may be utilized with the insert 10. Each side element is formed by rolling a rectangular panel upon itself to form a roll of cardboard or other material. In the present invention, the side elements 52, 54 are shown as having a generally rectangular cross-section. The side elements are located on opposing side panels 14, 16 of the compartment 12 and are shaped and located to absorb exterior forces imparted upon the side of the insert 10. In this manner, the side elements serve to further protect the electrical component from exterior loads or forces. The side cushioning elements 52, 54 further help to aid the insert in retaining its shape within an associated carton because the side elements extend outwardly a certain distance beyond the tips of the fold lines 56, 58. The side elements thereby protect the tips 56, 58 from receiving exterior forces. If the tips 56, 58 were to receive exterior forces, it could cause the hinge lines 26, 28 to move outwardly away from each other, which would restrict the flexibility or pivotability of the foot 22.

In operation, a pair of substantially identical inserts 10 are utilized to package a single electrical component 62. The inserts 10 are juxtaposed such that their mouths 60 face each other. The inserts are then slid over the electrical component as a sleeve and thereby suspend the electrical component 62 above the carton bottom 24.

In an alternate embodiment of the invention, a single unitary packaging system is utilized to package the component. The single unitary component has generally the same form and function as the pair of inserts described herein. However, the single unitary component is formed of a single piece of material, and has an opening flap to receive the component. This alternate embodiment of the invention (not shown) appears somewhat similar to the pair of inserts shown in page 6, photograph 11, of the photograph appendix. In one embodiment, the opening flap may be a side panel of the unitary packaging component. The unitary packaging component may also utilize side cushioning elements analogous to the side cushioning elements 52, 54.

The present invention also comprises a blank, generally designated 100 as shown in FIG. 1, which can be folded and glued to form a single insert 10 as described above. The blank 100 includes a base panel 101, a left side panel 102, a right side panel 104, and a bottom panel 120. Fold line 184 separates the left side panel 102 from the base panel 101. Fold line 210 separates the right side panel 104 from the base panel 101. Fold line 230 separates the bottom panel 120 from the base panel 101. A first top panel 108 extends from the left side panel 102 by fold line 182. The first top panel 108 has a receiving slot 112. Left wing panel 144 is connected to the left side panel 102 by left connecting tab 140. Fold line 180 separates the left connecting tab 140 from the left side panel 102. Fold line 178 separates the left connecting tab 140 from the left wing panel 144. Left wing panel 144 has fold lines 170, 172 and a plurality of fold lines 164 such that it may be rolled upon itself and held in position against the constructed blank. Left retaining tab 148 is connected to left wing panel 144 by fold line 176.

A second top panel 110 depends from the right side panel 104 by fold line 222. The second top panel 110 has a receiving slot 114. Right wing panel 156 is connected to right side panel 104 via right connecting tab 150. Fold line 161 connects the right connecting tab 150 to the right side panel 104. Fold line 168 separates the right wing panel 156 from the right connecting tab 150. Right wing panel 156 has fold lines 160, 166, and a plurality of fold lines 162 such that it can be rolled upon itself and held in position against the folded blank.

The left side panel 102 has diagonal fold lines 196 and 200. The right side panel 104 has diagonal fold lines 212 and 214. Diagonal fold line 198 passes through the left side panel 102 and the first top panel 108. Diagonal fold line 202 passes through the left side panel 102 and the bottom panel 120. Fold line 216 extends through the left side panel 102. Diagonal fold line 220 passes through the right side panel 104 and the second top panel 110. Diagonal fold line 208 passes through the right side panel 104 and the bottom panel 120. Fold line 218 extends through the right side panel 104.

The bottom panel 120 has a fold line 228. The base 138 extends from the bottom panel 120 by fold line 226. Left triangular tab 250 extends from the base 138 by fold line 204 and right triangular tab 252 extends from the base 138 by fold line 206.

To assemble the insert from the blank 100, left side panel 102 and right side panel 104 are folded inward along fold lines 184, 210 until perpendicular to the base panel 101. The first top panel 108 and the second top panel 110 are then inwardly folded along fold lines 182, 222 until they are perpendicular to the left side panel 102 and the right side panel 104, respectively. The first and second top panels overlappingly arranged. The right wing panel 156 and left wing panel 144 are then rolled upon their plurality of fold lines 162, 164 to create a pair of side cushioning elements having a generally rectangular cross-section. The right wing portion 156 and left wing portion 144 then outwardly folded along the fold lines 168, 161 and 178, 180 until the cushioned side panels lie flush along the left side panel 102 and right side panel 104. The right retaining tab 158 and left retaining tab 148 are then inserted into their respective receiving slots 114,112. In this manner, the side cushioning elements are held into place and a portion of the right and left wing panels 156, 144 are held flush against the second and first top panels 110,108. Furthermore, the cushioned panels lie flush against the side panels 102,104.

The compartment, comprised of the base 101, the side walls 102, 104, and the first and second top portion 108, 110, is then inwardly crimped along fold line 228. This crimping causing the compartment to fold along the fold lines 196, 198, 200, 202, 216 and fold lines 208, 212, 214, 220, and 218. The base 138 is then inwardly folded along fold line 226 until it is substantially perpendicular to the plane of the base panel 101. Right triangular tab 252 of the base 138 is then inwardly folded such that it may be inserted into a triangular pocket defined by fold lines 208 and 220. Left triangular tab 250 is then folded along its fold line 204 such that it may be inserted into a triangular pocket defined by fold lines 198 and 202.

The alternate unitary packaging component of the present invention is may be formed from a unitary blank (not shown). The inserts and unitary packaging component of the present invention may be formed from a variety of materials, including a range of types of cardboard and plastic, without departing from the scope of the invention. Material strength and thickness may be additionally varied. The dimensions and size of the present invention may be modified to adapt to packaging components of differing weights, sizes, and fragilities.

While the forms of apparatus herein described constitute a preferred embodiment of the invention, it is to be understood that the present invention is not limited to these precise forms and that changes may be made therein without departing from the scope of the invention.

What is claimed is:

1. An insert having an upper and lower surface for packaging an electrical component within a carton having a floor panel, the insert comprising:

a compartment for receiving said electrical component, said compartment having a pair of side panels and being generally rectangular in cross section; and a foot for contacting a floor panel of carton which suspends said compartment to protect said components from exterior forces during shipping, said compartment being inwardly collapsed along a pair of opposed parallel fold lines to form a pair of inwardly inclined opposed surfaces and a pair of outwardly inclined opposed surfaces, a hinge line thereby formed between each said inwardly inclined surface and its associated outwardly inclined surface, a first hinge line being located on said upper surface and an opposed, parallel second hinge line being located on said lower surface, said outwardly inclined opposed surfaces being bridged by a pair of triangular end flaps forming a pair of triangular pockets, said foot having a base extending from one of said outwardly extending surfaces and having triangular tabs receivable in said triangular pockets to retain said base in said pockets and form said foot, said foot extending downwardly below said compartment to contact said floor panel and being pivotable about said first and second hinge lines to thereby absorb outside forces.

2. The insert of claim 1 further comprising a pair of side cushioning elements, each of said side elements being formed by rolling a rectangular panel upon itself, said side elements being located on opposing side panels of said compartment, each said side element being shaped and located to absorb exterior forces imparted upon the side of said insert to protect an electrical component.

3. The insert of claim 2 wherein said side cushioning elements are substantially rectangular in cross section.

4. The insert of claim 3 wherein said compartment and said base are oriented in substantially perpendicular planes.

5. The insert of claim 4 wherein the width of said compartment and said pair of side cushioning elements is greater than the length of said first or said second hinge line.

6. A suspension assembly for packaging an electrical component within a carton having a floor panel, the assembly comprising:

a pair of inserts to be used in combination, wherein each of said inserts has an upper surface and a lower surface and comprises a compartment having a pair of side panels, said compartment being generally rectangular in cross section and defining a mouth for receiving an electrical component, each of said inserts further comprising a foot for contacting a floor panel of a carton for suspending said compartment to protect said component from exterior forces during shipping, said compartment being inwardly collapsed along a pair of opposed parallel fold lines to form a pair of inwardly inclined opposed surfaces and a pair of outwardly inclined opposed surfaces, a hinge line thereby formed between each said inwardly inclined surface and its associated outwardly inclined surface, a first hinge line being located on said upper surface and an opposed, parallel second hinge line being located on said lower surface, said outwardly inclined opposed surfaces being bridged by a pair of triangular end flaps forming a pair of triangular pockets, said foot having a base extending from one of said outwardly extending surface and having triangular tabs receivable in said triangular pockets to retain said base in said pockets and form said foot, said foot extending downwardly below said compartment to contact said floor panel and being pivotable about said first and second hinge lines such that when said inserts are juxtaposed with both said mouths facing each other and slid over said electrical component as a sleeve said inserts thereby suspend said electrical component above said floor panel and are pivotable about their associated hinge lines to thereby absorb outside forces.

* * * * *